United States Patent [19]

Zitzman

[11] 4,340,193

[45] Jul. 20, 1982

[54] VARIABLE CAPACITY FEED REEL FOR COILED WIRE

[76] Inventor: George E. Zitzman, 131 Tanners Pond Rd., Garden City, N.Y. 11530

[21] Appl. No.: 171,663

[22] Filed: Jul. 24, 1980

[51] Int. Cl.[3] ..... B65H 49/00

[52] U.S. Cl. ..... 242/129.72; 242/129

[58] Field of Search ..... 242/128, 129, 129.5, 242/129.72, 156, 156.2, 54 R

[56] References Cited

U.S. PATENT DOCUMENTS 2,390,158 12/1945 Kramer ..... 242/128

2,946,536 7/1960 Froelich ..... 242/128

*Primary Examiner*—Leonard D. Christian

*Attorney, Agent, or Firm*—Eisenman, Allsopp & Strack

[57] ABSTRACT

A reel assembly for rapidly feeding wire from heavy coils over a range of sizes, with the coil being clamped in a basket rotatably mounted within an inwardly tapering conical shield and with wire being guided from the coil by a split annular deflector bar coaxial with the coil and opening into a wire-confining guide which is vertically adjustable. The frame supporting the reel assembly extends away laterally from the conical shield to carry a support for a spring guide through which the wire passes on its way to a forming machine.

8 Claims, 4 Drawing Figures

VARIABLE CAPACITY FEED REEL FOR COILED WIRE

BACKGROUND

The metal from which many products such, for example, as coiled springs, are formed comes in large diameter coils of metal wire or tape of great length. The high inertia of the raw coils and the inherent resilience of the metal makes feeding at high speeds in interrupted cycles difficult and hazardous. Flailing limbs of wire and rapidly rotating cages and carriers must be contained and controlled both to facilitate high-speed fabrication by the processing machines and to protect personnel. The present invention directs itself to effective solutions for these problems.

SUMMARY OF THE INVENTION

A master frame carries at one end a vertically adjustable post carrying at its upper end a swivel-mounted extension spring, the free end of which supports a transverse tubular guide through which the wire is threaded on the way to a forming machine from the reel assembly at the opposite end of the master frame. The reel assembly takes the form of an inverted cone, the outer walls of which define a housing for a passively rotatable cage in which is secured a raw coil of wire to be processed into products such as springs. A brake assembly provides drag and stopping forces to control rotation and overrun and an adjustable guide and split deflector ring control the wire as it uncoils from the rotating cage.

DESCRIPTION OF THE PREFERRED EMBODIMENT

Figure 1:
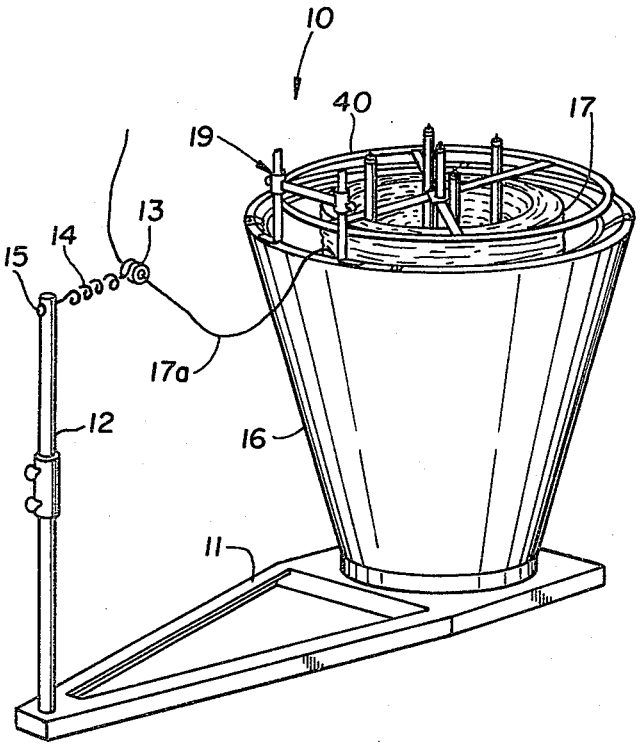
FIG. 1 is a view in perspective showing a complete reel assembly setup for feeding wire to a forming machine.

Referring to FIG. 1, there is shown a reel assembly 10 including a base portion 11 elongated laterally to support a vertically adjustable post 12 carrying on its upper end a transverse guide 13 which can be formed, for example, of coiled wire. The guide 13 is carried at the free end of an extension spring 14 joined to a swivel connection 15 to the post 12, the assembly as a whole constituting a "dancer" for effecting wire control as hereinafter described. Also supported on the base 11 is a real assembly including a housing 16 in the form of a section of a cone having upwardly divergent walls. A coil of wire 17 is rotatably mounted within the housing to turn freely on a central axis 18, with the free end 17*a* of the wire from the coil 17 being passed through a preliminary guide 19 and the guide 13 on its way to the processing machine (not shown) where it can be formed, for example, into elongated coil springs. The action of a typical processing machine for forming springs results in the rapid intermittent drawing of the wire from the coil 17 at high rates of linear speed. The apparatus of the present invention is designed to facilitate the orderly uncoiling of the wire and feed to the processing machine, as well as to protect operating personnel.

Figure 2:
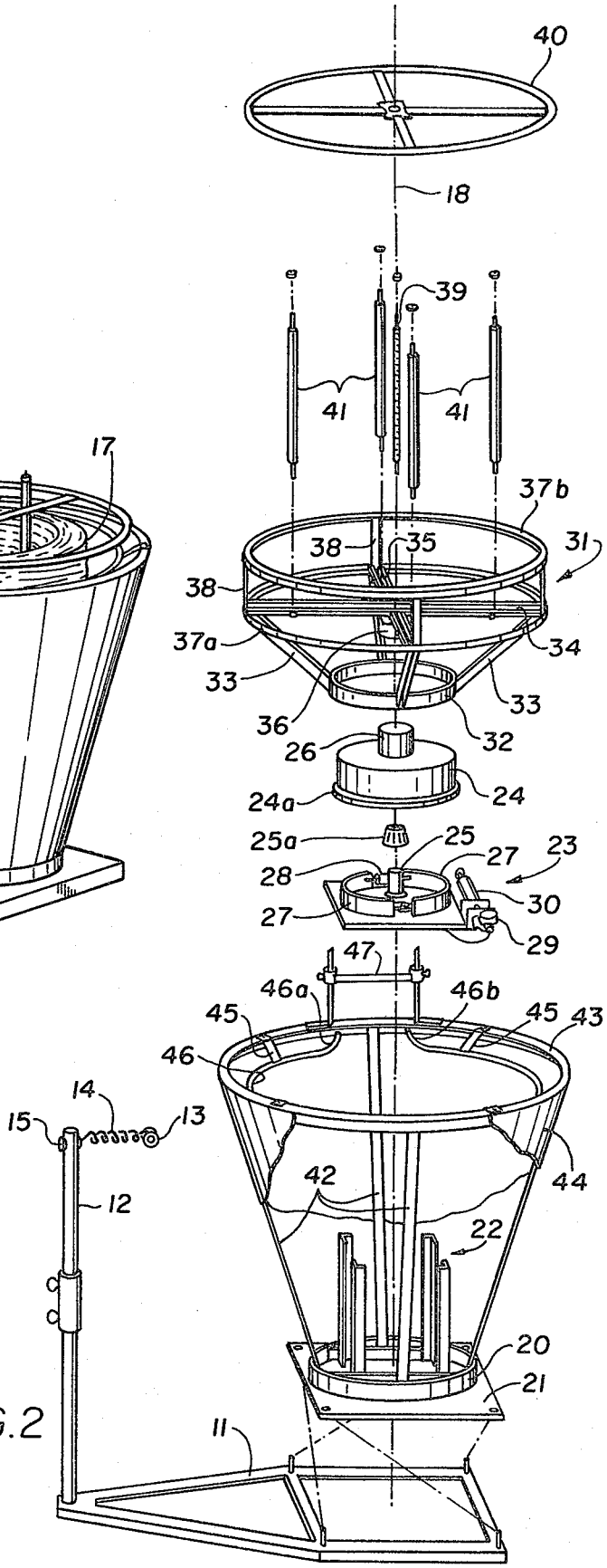
FIG. 2 is an exploded view in perspective of the reel assembly, with the base 11 rotated 90°.

Referring to FIG. 2, the lower end of the reel assembly 11 comprises a metal ring 20 secured to a base plate 21 which is in turn secured to the master base 11. A four-legged pedestal 22 is rigidly secured to the plate 21 to carry a rotary bearing and brake assembly, indicated generally by the numeral 23, and including a drum 24 rotatably mounted on an axle 25 through tapered roller bearings 25*a*. The drum carries a stub shaft 26 on its upper surface. Pivotally mounted within the drum are brake shoes 27 adapted to be expanded against the drum by a hydraulic cylinder 28 operated by a master cylinder 29 which is regulated by an adjustable screw-driven spring assembly 30, so arranged that it applies in precisely variable amount permanent drag to the rotary assembly as might be required.

Figure 3:
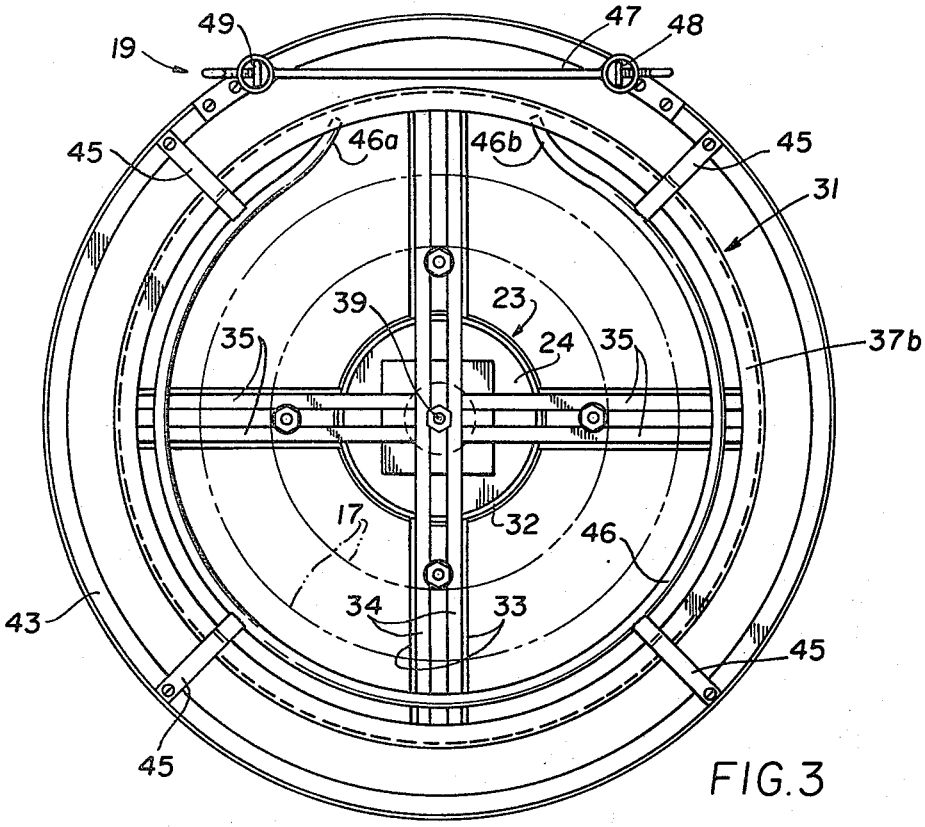
FIG. 3 is a top view of the wire guide, coil basket and tapered shield.
Figure 4:
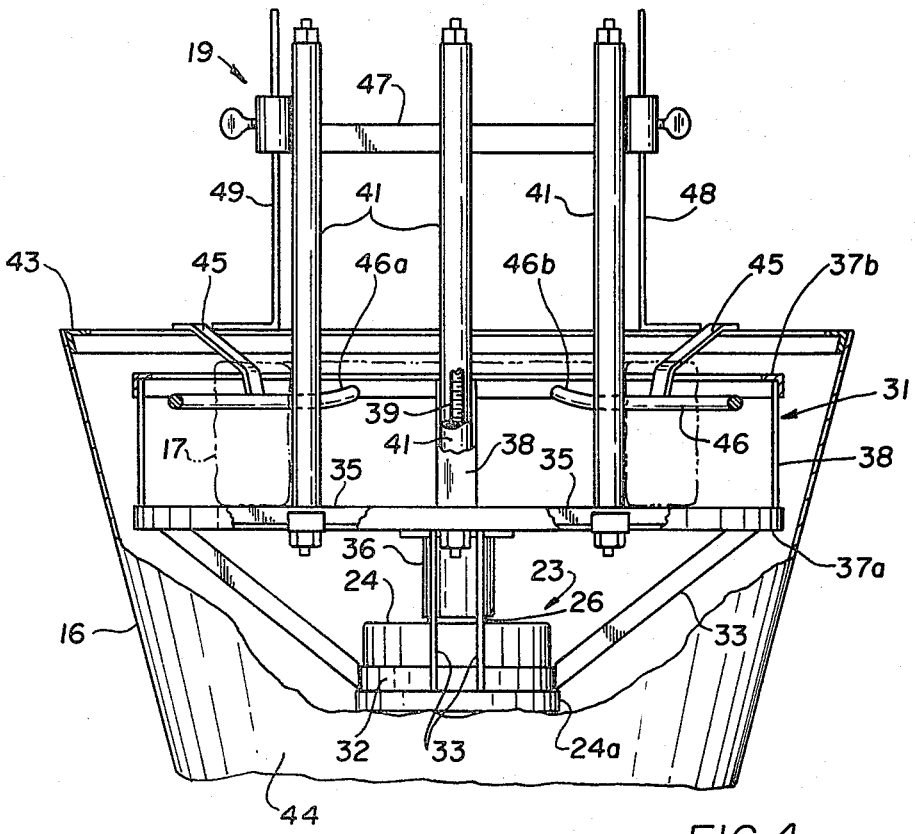
FIG. 4 is a side view of the wire guide, coil basket and part of the tapered shield.

Removably seated on the stub shaft 26 is a basket assembly 31, the size of which is selected to accommodate coils of wire of many different sizes and types. The basket assembly 31 includes a base ring 32 adapted to fit over the drum 24 to seat on the flange 24*a*. A series of four upwardly inclined braces 33 are joined to the ring 32 at their lower ends and at their upper ends to a ring 37*a* and to the outer ends of crosspieces 34 and 35, also shown in FIGS. 3 and 4, formed of double-channel members. Secured at the intersection of the crosspieces is a downwardly extending collar 36 adapted to seat on the stub shaft 26. A circular fence 37*b* carried by the four upstanding legs 38 defines the perimeter of the basket which holds the coil of wire.

An upstanding center rod 39 is secured at the center axis of the basket 31 to receive a circular top guard 40 adapted to be bolted down on the top of the coil of wire. A central hub for the coil of wire is defined by four upstanding arms 41 slidably adjustably mounted at their lower ends in the crosspieces 34 and 35, with the arms 41 being moved radially outwardly or inwardly as required to securely anchor the coil 17 concentrically within the basket 31 as it spins on the rotary hub 24.

Attached at their lower ends to the base ring 20 and inclining downwardly are four support legs 42 to the top of which is secured a guard ring 43 which is concentric with respect to the axis of rotation of the basket 31. Secured to the legs 42 and the ring 43 is a metal sheath 44 to shield the mechanism and to control the action of the unwinding coil and its flailing limbs during moments of overrun, as described more particularly below. Secured to the ring 43 by the fingers 45 is a split annular deflector guard 46, the open edge of which is defined by outwardly and upwardly bent tips 46*a* and 46*b* which closely underlie the ring or fence 37*b* to guide the wire over the fence. Adjacent the opening in the deflector is the guide 19 which includes a vertically adjustable top bar 47 supported by the ring 43 by means of legs 48 and 49. In the exploded view of FIG. 2, the deflector guard 46 is shown bolted to the outer ring 43 with the basket assembly removed. It should be noted that to install the basket assembly, the deflector guard must first be removed and then reassembled after the basket is in place.

To operate the reel assembly, the cover ring 40 is first lifted off the central shaft 39 and the wire coil 17 dropped into the basket surrounding the four legs 41 which are slid outwardly equidistant from the central axis to engage the coil and secure it concentrically in position with the cover ring 40 then being lowered onto the top of the coil and secured against upward movement although capable of falling by gravity as the coil unwinds. The free end of the wire, as best seen in FIG. 1, is brought out through the guide 19 threaded through the guide 13 of the dancer and passed to the processing machine (not shown). As the processing machine draws wire from the reel, it causes the reel assembly to rotate against whatever drag force is imposed by the brake pads 27 on the drum 24, with the dancer by virtue of the extension spring 14 absorbing violent changes in tension. In the case of a forming machine which is fabricating elongated coil springs, a substantial length of wire is drawn from the reel at relatively high speeds imparting rotary motion to the reel assembly under conditions of high inertia. At the completion of the forming operation of each spring, the drawing of wire from the reel abruptly ceases. Before the rotary motion of the reel is arrested, however, overrun can occur in the limbs of wire between the reel and the processing machine. A small portion of the overrun can be taken up by the extension spring 14, but the balance appears as one or more loops of wire between the guides 19 and 13 moving randomly under highly dynamic conditions. The downwardly converging walls of the sheath 44 protect the rotary mechanism from the free wire by urging it at times of impact with the sheath in a downward direction, assuring that it does not get caught in the exposed mechanism at the upper end. The sheath and the closed circular configuration of all exposed moving parts also effectively protect the personnel.

While the invention has been described above having reference to one preferred embodiment thereof, it will be understood that it can take other forms and arrangements within the scope of the invention. Thus, for example, spools of wire can be accommodated rather than the free coil with a large core opening as described above. To this end, the four radially adjustable upstanding arms 41 can be removed and a spool (not shown) can be fitted over the center rod and clamped in place. Also, coils of material other than circular wire can be accommodated such, for example, as rectangular or flat wire in strip form. The invention should not, therefore, be regarded as limited except as defined in the following claims.

I claim:

1. A reel assembly for feeding coiled wire material to a processing machine comprising a vertical axis rotatable support to receive the coil, means to secure the coil coaxially therein, guide means to control the wire passing from the coil to a processing station, and a stationary circular housing concentric with respect to the axis of rotation and having downwardly converging walls to define a section of an inverted cone having an upper portion containing the rotatable support.

2. A reel assembly according to claim 1, including a wire guide secured to the upper edge of the housing and through which the wire passes, an annular deflector secured to the upper edge of the housing to surround the coil.

3. A reel assembly according to claim 2, said guide including a pair of upstanding leg portions and a horizontal crosspiece means to mount the horizontal cross piece on the legs for vertical adjusting movement to control the opening of the guide.

4. A reel assembly according to claim 2, said rotatable support for the wire comprising a circular basket, said annular deflector being disposed within the perimeter of the basket.

5. A reel assembly according to claim 3, including a laterally extended base portion, a post secured to the extended portion and a wire guide secured near the upper end of the post comprising a horizontal extension spring, a horizontal axis swivel connection between the spring and the post and a transverse guide secured to the free end of the spring.

6. A reel assembly according to claim 5, said transverse guide comprising a coiled spring secured at its midpoint to the extension spring.

7. A reel assembly according to claim 1, said support for the coil comprising a drum rotatable on a vertical axis and having a lower radially extending flange and a central upstanding stub shaft, and an annular basket seated on the drum comprising a lower ring to seat on the flange and a central coller to seat on the stub shaft, a plurality of horizontal bottom supports radiating outwardly from the collar, a plurality of support braces joining the outer ends of the bottom supports to the lower ring, a closed annular member joined to the horizontal supports at their outer ends, an annular fence, and means to secure the fence to the annular member coaxially therewith to define a basket for the coil of wire.

8. A reel assembly as set forth in claim 7, including a plurality of upstanding members carried by the respective bottom members, means to secure the upstanding members to the bottom members for radial positioning movement relative to the vertical axis of rotation to define a central hub for the coil of wire.

* * * * *